US011401894B2

(12) United States Patent
Karlsson et al.

(10) Patent No.: US 11,401,894 B2
(45) Date of Patent: Aug. 2, 2022

(54) AIR CLEANER HOUSING, AN AIR CLEANER HOUSING ARRANGEMENT, AND A METHOD

(71) Applicant: Volvo Truck Corporation, Gothenburg (SE)

(72) Inventors: Sebastian Karlsson, Lidköping (SE); Magnus Halldin, Romelanda (SE); Leo Ekbom, Torslanda (SE)

(73) Assignee: Volvo Truck Corporation, Gothenburg (SE)

( * ) Notice: Subject to any disclaimer, the term of this patent is extended or adjusted under 35 U.S.C. 154(b) by 0 days.

(21) Appl. No.: 17/276,195

(22) PCT Filed: Sep. 14, 2018

(86) PCT No.: PCT/EP2018/074918

§ 371 (c)(1),
(2) Date: Mar. 15, 2021

(87) PCT Pub. No.: WO2020/052782

PCT Pub. Date: Mar. 19, 2020

(65) Prior Publication Data

US 2022/0154672 A1 May 19, 2022

(51) Int. Cl.
*F02M 35/02* (2006.01)
*F02M 35/04* (2006.01)

(52) U.S. Cl.
CPC ..... *F02M 35/0204* (2013.01); *F02M 35/048* (2013.01)

(58) Field of Classification Search
CPC ..... F02M 35/0204; F02M 35/0201; F02M 35/048
See application file for complete search history.

(56) References Cited

U.S. PATENT DOCUMENTS 6,026,775 A * 2/2000 Yamane ..... F02M 35/1255 123/184.53
6,167,862 B1 1/2001 Powell et al.
(Continued)

FOREIGN PATENT DOCUMENTS

CN 201016319 Y 2/2008
CN 103523501 A 1/2014
(Continued)

OTHER PUBLICATIONS

International Search Report and Written Opinion for PCT/EP2018/074918, dated Jan. 7, 2019, 11 pages.
(Continued)

*Primary Examiner* — Hung Q Nguyen
(74) *Attorney, Agent, or Firm* — Withrow & Terranova, PLLC

(57) ABSTRACT

The invention relates to an air cleaner housing (200) for an air filter for an internal combustion engine in a vehicle, the air cleaner housing (200) being adapted for attachment to an outer cover (100) of said internal combustion engine (100), and comprising an inlet (201) for receiving unfiltered air and an outlet (202) for outputting filtered air. The air cleaner housing (200) comprises at least one slide member (210) configured to be slidably arranged to a corresponding guide member (110) of said outer cover (100), such that, when said slide member (210) is in connection with said guide member (110), said air cleaner housing (200) is supported by said guide member (110), and said air cleaner housing (200) is slidably movable at least along said guide member (110); and a fixation member (220) configured to secure the housing (200) to the outer cover (100) in a fixed position along said guide member (110). The invention also relates to an air cleaner housing arrangement, a method, and a vehicle.

14 Claims, 8 Drawing Sheets

(56) References Cited

U.S. PATENT DOCUMENTS

| | | | | |
|---|---|---|---|---|
| 2005/0022956 | A1 | 2/2005 | Rodriguez et al. | |
| 2006/0288672 | A1 | 12/2006 | Miyake et al. | |
| 2009/0211450 | A1 | 8/2009 | Mosset et al. | |
| 2014/0223868 | A1 | 8/2014 | Kaufmann et al. | |
| 2015/0136501 | A1* | 5/2015 | Ueda | E02F 9/0883 123/184.21 |
| 2017/0009638 | A1* | 1/2017 | Suetou | F01N 3/2066 |
| 2017/0218822 | A1* | 8/2017 | Yamashita | F02B 67/00 |

FOREIGN PATENT DOCUMENTS

| | | | |
|---|---|---|---|
| CN | 204327336 | U | 5/2015 |
| CN | 204629760 | U | 9/2015 |
| CN | 205414542 | U | 8/2016 |
| CN | 205751778 | U | 11/2016 |
| CN | 205977491 | U | 2/2017 |
| CN | 107405557 | A | 11/2017 |
| DE | 9321599 | U1 | 4/2000 |
| EP | 1396335 | A1 | 3/2004 |
| GB | 9326550 | A | 7/1994 |
| JP | S53139415 | U | 11/1978 |

OTHER PUBLICATIONS

International Preliminary Reporton Patentability for PCT/EP2018/074918, dated Oct. 30, 2020, 13 pages.
First Office Action for Chinese Patent Application No. 201880097426.X dated Jan. 27, 2022, 16 pages.

* cited by examiner

AIR CLEANER HOUSING, AN AIR CLEANER HOUSING ARRANGEMENT, AND A METHOD

This application is a 35 USC 371 national phase filing of International Application No. PCT/EP2018/074918, filed Sep. 14, 2018, the disclosure of which is incorporated herein by reference in its entirety.

TECHNICAL FIELD

The invention relates to an air cleaner housing for an air filter for an internal combustion engine in a vehicle. The air cleaner housing is adapted for attachment to an outer cover of said internal combustion engine, and comprises an inlet for receiving unfiltered air and an outlet for outputting filtered air. Moreover, the invention relates to an air cleaner housing arrangement, an air inlet arrangement, a method and a vehicle.

The invention can be applied in heavy-duty vehicles, such as trucks, buses and construction equipment. Although the invention will be described with respect to a truck, the invention is not restricted to this particular vehicle, but may also be used in other vehicles such as buses and construction equipment vehicles.

BACKGROUND

An internal combustion engine receives air to combust fuel in a combustion chamber to produce power. Such an engine is provided with an intake system in order to supply air from the outside of the vehicle to the internal combustion engine.

The air intake system of a vehicle may include an air intake followed by an intake duct, for supplying air to an air cleaner arrangement. The air cleaner arrangement typically comprises an air cleaner housing in which an air filter is arranged, to filter the air from dust by passage through the air filter before reaching the internal combustion engine. Air cleaner arrangements and air filters may be designed in many different shapes and configurations. The most common solution in today's trucks is to use a cylindrical air cleaner with a cylindrical air filter, although e.g. conical designs are also conceivable.

Conventionally, some parts of the air intake system are mounted to the cab of the vehicle, and some parts are mounted on the chassis. The parts that are mounted on the chassis need to be assembled on a main construction line. Since space on the main construction line is limited, it is generally preferred if assembly work can instead be done off the main line.

Further, if the air cleaner of the air intake system is mounted on the main construction line, this means that the air cleaner will not be present in the engine pre-assembly station, and accordingly, the engine is not in condition to be test-started until end of line.

When the outlet of an air cleaner of the air intake system is to be connected to an inlet for bringing the filtered air towards the internal combustion engine, tolerances may be small. Sometimes, it is desired to mount the outlet of the air cleaner to an inlet of the engine via e.g. one or more separate piping parts. Sometimes, the air cleaner may be premounted with a part of a piping system already attached to the outlet of the air cleaner housing. The mounting may be difficult and time consuming due to small tolerances and variations between the connecting parts.

CN 204327336 describes an air filter holder with an air cleaner bracket and a slide rail. When the air cleaner needs to be repaired, the position of the air cleaner can be changed by moving the position of the bracket body on the slide rails.

In view of the above, it would be desirable to facilitate the mounting of an air cleaner in an air intake system to a combustion engine in a vehicle.

SUMMARY

An object of the invention is to provide an air cleaner housing and/or an air cleaner housing arrangement, and/or a method which provides for facilitated mounting of the air cleaner housing, and/or performing the mounting off the main line.

The object is achieved by a cleaner housing according to claim 1, an air cleaner housing arrangement according to claim 11, and/or a method according to claim 17.

As such, the invention relates in a first aspect to an air cleaner housing for an air filter for an internal combustion engine in a vehicle. The air cleaner housing is adapted for attachment to an outer cover of said internal combustion engine, and comprises an inlet for receiving unfiltered air and an outlet for outputting filtered air. The air cleaner housing comprises at least one slide member configured to be slidably arranged to a corresponding guide member of the outer cover, such that, when the slide member is in connection with the guide member, the air cleaner housing is supported by the guide member. Also, when the slide member is in connection with the guide member, the slide member is slidably movable at least along said guide member. The air cleaner housing further comprises a fixation member configured to secure the housing to the outer cover in a fixed position along said guide member.

In a second aspect, the invention relates to an air cleaner housing arrangement comprising an air cleaner housing for an air filter for an internal combustion engine in a vehicle, and an outer cover of said internal combustion engine, wherein the air cleaner housing is adapted for attachment to said outer cover of said internal combustion engine, and comprises an inlet for receiving unfiltered air and an outlet for outputting filtered air. The outer cover comprises at least one guide member, and the air cleaner housing comprises at least one slide member, the slide member and the guide member being mutually configured such that the slide member is slidably arrangeable to said guide member, such that, when the slide member is in connection with said guide member, said air cleaner housing is supported by said guide member, and said air cleaner housing is slidably movable at least along said guide member. The air cleaner housing is further comprising a fixation member configured to secure the housing to the outer cover in a fixed position along said guide member.

As explained in the background section, the outlet of an air cleaner housing is generally configured for connection to an engine air inlet for leading filtered air towards the internal combustion engine. The air cleaner housing is slidably movable at least along the guide member to enable coupling of the outlet of the air cleaner housing to an engine air inlet.

That the outlet is configured for connection to an engine air inlet means that the outlet is intended to be coupled to piping for leading the filtered air from the outlet towards the engine. The engine air inlet may for example be an inlet to a turbo or to a compressor arranged upstream the engine per se. The outlet of the air cleaner housing may be coupled to an engine air inlet e.g. via a plurality of piping parts. Optionally, the air cleaner housing may be provided with a piping part which is premounted to the outlet of the air cleaner housing. In this case, the premounted piping part may be fitted to additional piping parts to reach the engine air inlet during mounting of the air cleaner housing to the engine. Since the air cleaner housing as proposed herein provides for facilitated connection of the outlet to the engine air inlet, it may provide possibilities for using e.g. one single piping part where previously a plurality of piping parts were required.

The air cleaner housing is adapted for attachment to an outer cover of the internal combustion engine. Accordingly, the air cleaner housing may be mounted to the internal combustion engine in an engine pre-assembly station, rather than in the main production line. This means that the engine and the air cleaner may also be test-run at the pre-assembly stage. Further, by provision of the slide member, the air cleaner housing may be slidably arranged to a corresponding guide member of the outer cover of the engine. This enables the air cleaner housing to be provisionally movably mounted to the guide member before coupling the outlet of the air cleaner housing to the engine air inlet.

Since the air cleaner housing is supported by the guide member when the slide member is in connection with the guide member, no additional support is required while the outlet of the air cleaner cover is mounted to the engine air inlet. Hence, any grips or tools used for supporting the air cleaner housing while connecting the slide member to the guide member may be removed. Further, since when the slide member is in connection with the guide member, the slide member is slidably movable along the guide member, the air cleaner housing may be moved back and forth along the guide member while coupling the outlet of the air cleaner housing to the engine air inlet. This facilitates the coupling of the outlet, e.g. to a compressor pipe.

The provision of the fixation member allows for the air cleaner housing to be secured to the outer cover in a fixed position once the outlet of the air cleaner housing is coupled to the engine air inlet. The fixed position is accordingly a fixed position along the guide member.

Optionally, the fixed position may be a freely selectable position along the guide member. Optionally, the fixed position may be a pre-defined position along the guide member. For example, one or more fixation devices may be provided on the engine cover so as to provide pre-defined fixed positions.

Optionally, the slide member is configured to be pivotable about the corresponding guide member when slidably arranged thereto, such that, when said slide member is in connection with said guide member, said air cleaner housing is pivotable about the guide member. For the air cleaner housing assembly, this may be expressed as that optionally, the slide member and the guide member are mutually configured such that the slide member is pivotable about the guide member when slidably arranged thereto, such that, when said slide member is in connection with said guide member, said air cleaner housing is pivotable about the guide member.

By provision of the slide member being not only slidable along the guide member, but also pivotable about the corresponding guide member, further freedom of movement is available when connecting the outlet of the air cleaner housing to the engine inlet.

Generally, it will be understood that the guide member will define a guide path, along which the slide member may slide back and forth. That the slide member is pivotable about the corresponding guide member means that the slide member is pivotable in a plane perpendicular to said guide path.

Optionally, the guide path of the guide member will follow a straight line. Optionally, the guide member is elongated.

Optionally, an axial direction of the air cleaner housing may be defined along an axis centrally through the outlet of the air cleaner housing.

The slide member may be configured so as to be slidably arranged to the guide member such that the air cleaner housing is movable along the guide member in a direction parallel to the axial direction of the air cleaner housing.

Optionally, the air cleaner housing may comprise a single slide member. Preferably, such single slide member may extend along the axial direction of the air cleaner housing, and preferably along a substantial part of an axial length of the air cleaner housing.

Optionally, the air cleaner housing may comprise more than one slide member, that is, the air cleaner housing may comprise a plurality of slide members. In particular, the air cleaner housing may comprise between two and six slide members. In one variant, the air cleaner housing may comprise two slide members. In another variant, the air cleaner housing may comprise four slide members.

When the air cleaner housing comprises at least two slide members, the slide members may optionally be arranged in line, parallel to the axial direction of the air cleaner housing When the air cleaner housing comprises at least two slide members, the slide members may optionally be arranged side by side, that is in line along an axis perpendicular to the axial direction. In this case, one guide member will generally be required per slide member.

The outer cover of the engine may be provided with more than one guide member, that is, the outer cover of the engine may be provided with a plurality of guide members.

When the air cleaner housing comprises a plurality of slide members, optionally, the outer cover may be provided with one corresponding guide member, to which more than one of said plurality of slide members is configured to be arranged.

When the air cleaner housing comprises a plurality of slide members, optionally, the outer cover may be provided with a plurality of corresponding guide members.

For example, one corresponding guide member may be provided for each one of the plurality of slide members.

Optionally, the slide member is protruding from the housing. By provision of a protruding slide member, numerous options for the connection to a guide member is available, in particular without impact on the remainder of the air cleaner housing which may be conventionally shaped. A protruding slide member may conveniently be arranged to a guide member. The corresponding guide member may advantageously be in the form of a groove in which the protruding guide member may be slidably arranged.

Optionally, the guide member may be protruding from the engine cover. For example, the guide member may be a member arranged to the engine casing. Optionally, the guide member may instead be formed in the engine cover, for example the guide member may form a groove in the engine cover.

Optionally, the slide member defines at least one abutment surface which is facing towards the housing. With "facing towards the housing" is meant a surface having a normal which extension will eventually reach a surface of the housing.

Optionally, the guide member defines at least one abutment surface which is facing away from the housing.

An abutment surface of the slide member facing towards the housing may abut against a corresponding abutment surface of the guide member, facing generally away from the housing. The abutment between the two surfaces may be efficient to hold the slide member to the corresponding guide member, such that the air cleaner housing is supported by the guide member by the connection between the slide member(s) and the guide member(s). Hence, when mounting the air cleaner housing to the engine cover, the air cleaner housing is supported by the guide member while its position may be manipulated by sliding and/or pivotable movement in relation to the guide member.

Optionally, the slide member of the guide member may form a partly circular cross-section as seen in a plane perpendicular to the axial direction of the air cleaner housing, that to the guide member. Such a slide member may for example be provided in the form of a generally cylindrical bar. The corresponding guide member or slide member may provide an indentation, such as a groove.

Optionally, the slide member or the guide member may comprise a generally spherical protrusion.

Optionally, the slide member or guide member may form a widened portion, intended to be housed in the corresponding guide member or slide member, and a narrowed portion connecting the widened portion to the housing or engine cover.

Optionally, the fixation member is separate from the slide member. Thus, the slide member may be configured to enable the desired movement along/across the guide member, whereas the fixation member may be configured to enable fixation of the air cleaner housing in relation to the engine outer cover.

Optionally, the fixation member may be protruding from the air cleaner housing. Hence, the fixation member may extend radially from a position on the outside of the air cleaner housing, enabling attachment of an outer end of the fixation member to the engine outer cover.

Optionally, the outer cover may be provided with a corresponding fixation device to which the fixation member may be attached.

A protruding fixation member may form a leg supporting the air cleaner housing when fixated to the outer cover.

As such, when a protruding fixation member(s) is used together with a protruding slide member(s), the members may be arranged so as to form a plurality of legs supporting the air cleaning cover. For example, the members may be arranged so as to form four legs for supporting the air cleaning cover. In this case, at least one of the legs may be a fixation member, and at least one of the legs may part of be a slide member.

Optionally, the fixation member is located at an angle of between 20 and 90 degrees from the slide member, as seen from a longitudinal axis centrally through the outlet of the air cleaner housing, preferably between 30 and 50 degrees. This arrangement provides for that a pivotable movement of the slide member in relation to the guide member may be performed without being hindered by the fixation member. Further, the angular distance between the fixation member and the slide member may be useful for providing stable support of the air cleaner housing.

Optionally, the fixation member is elongated, such as generally forming a bar, preferably a dog-bone bracket.

Optionally, the slide members and/or fixation members are configured so as to provide a space between the air cleaner housing in general and the engine cover. Such a space is desired for hindering heat from the engine to be transferred to the air cleaner housing.

Optionally, the air cleaner housing comprises at least two slide members, and/or wherein the outer cover comprises at least two guide members.

Optionally, the outer cover may be provided with at least one fixation device configured for securing the housing to the outer cover by cooperation with said fixation member.

Optionally, the guide member or slide member may comprise an open end into which the corresponding slide member or guide member may be threaded by approaching the members along a direction parallel to the sliding direction of the guide member. However, other variants are possible. For example the slide member may be coupled to the guide member e.g. by pivoting the slide member towards the guide member. In this case, the slide member may for example be in the form of a hook.

Optionally, the arrangement of the slide member and the guide member may provide for movement of the slide member along the guide member over a length being at least 1 cm, preferably at least 2 cm, most preferred at least 5 cm.

Optionally, the slide member(s) and/or fixation member(s) may be arranged to support the air cleaner housing at a distance from the engine cover. This has the advantage of providing a space between the engine cover and the air cleaner housing, so as to hinder heat from the engine from reaching the air cleaner housing.

Optionally, the side member(s) and/or fixation member(s) may be at least four, preferably the at least four side member(s) and/or fixation member(s) are arranged to symmetrically support the air cleaner housing when fixed to the engine cover.

The air cleaner housing arrangement as described in the above may advantageously comprise an air cleaner housing as described in relation to the first aspect of the invention.

Moreover, it is understood that the features and advantages described in relation to the first aspect of the invention is similarly applicable to the second aspect of the invention, and may be combined with each other.

In a third aspect, there is provided an internal combustion engine arrangement comprising an air cleaner housing arrangement in accordance with the second aspect. The internal combustion engine arrangement may comprise an internal combustion engine having an engine air inlet, to which the outlet of the air cleaner housing is connected.

In a fourth aspect, there is provided a method for mounting an air cleaner housing as described in the above to an outer cover of an engine comprising an engine air inlet, which outer cover comprises a guide member. The method comprises the steps of:

(S1) connecting the slide member of the housing to the guide member of the outer cover, so as to slidably arrange the housing to the guide member, (S2) connecting the outlet of the housing to the engine air inlet towards the engine, and (S3) fixing the fixing member of the housing to the outer cover so as to secure the housing in a fixed position along the guide member.

Optionally, the step (S2) of connecting the outlet of the housing to the inlet towards the engine comprises connecting the outlet an inlet being an inlet to a compressor and/or a turbo.

Optionally, the step of connecting the outlet to the engine air inlet is performed using a single part connection.

In a fifth aspect, there is provided a vehicle, preferably a truck, bus or construction equipment vehicle, comprising an air cleaner housing according to the first aspect and/or an air filter arrangement according to the second aspect and/or an engine according to the third aspect.

It will be understood that features and advantages described herein with reference to any aspect of the invention may similarly be applied to the other aspects of the invention.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings:

In FIGS. 3 to 7, like reference numbers refer to similar features.

DETAILED DESCRIPTION OF EXAMPLE EMBODIMENTS OF THE INVENTION

The invention will be described below for a vehicle in the form of a truck 1 such as the truck illustrated in FIG. 1. The truck 1 should be seen as an example of a vehicle which could comprise an air cleaner housing and/or an air cleaner arrangement as described herein.

However, the present invention may be implemented in a plurality of different types of vehicles. Purely by way of example, the present invention could be implemented in a truck, a tractor, a car, a bus, a work machine such as a wheel loader or an articulated hauler, or any other type of construction equipment.

Figure 1:
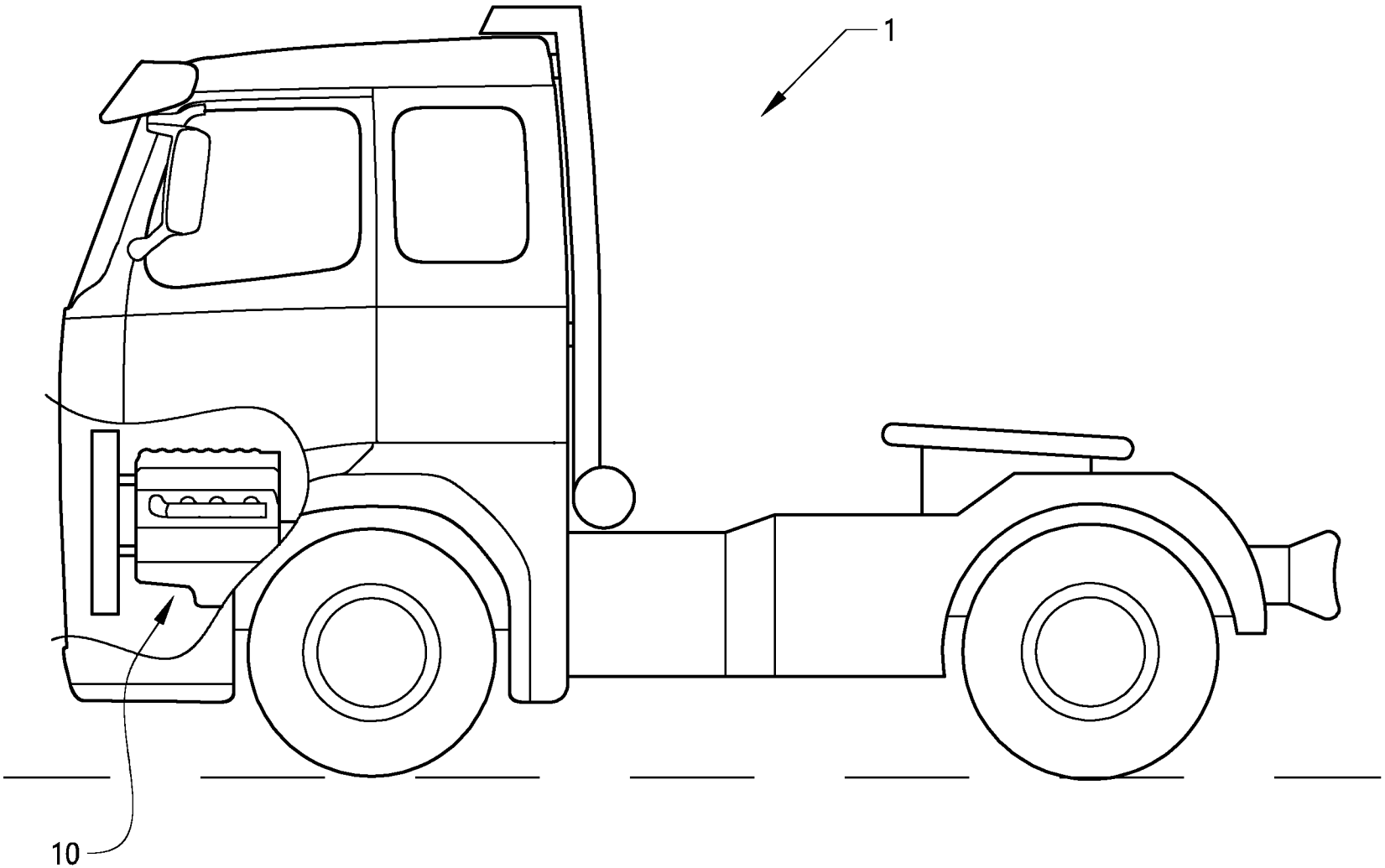
FIG. 1 is a schematic view of a vehicle.
Figure 2:
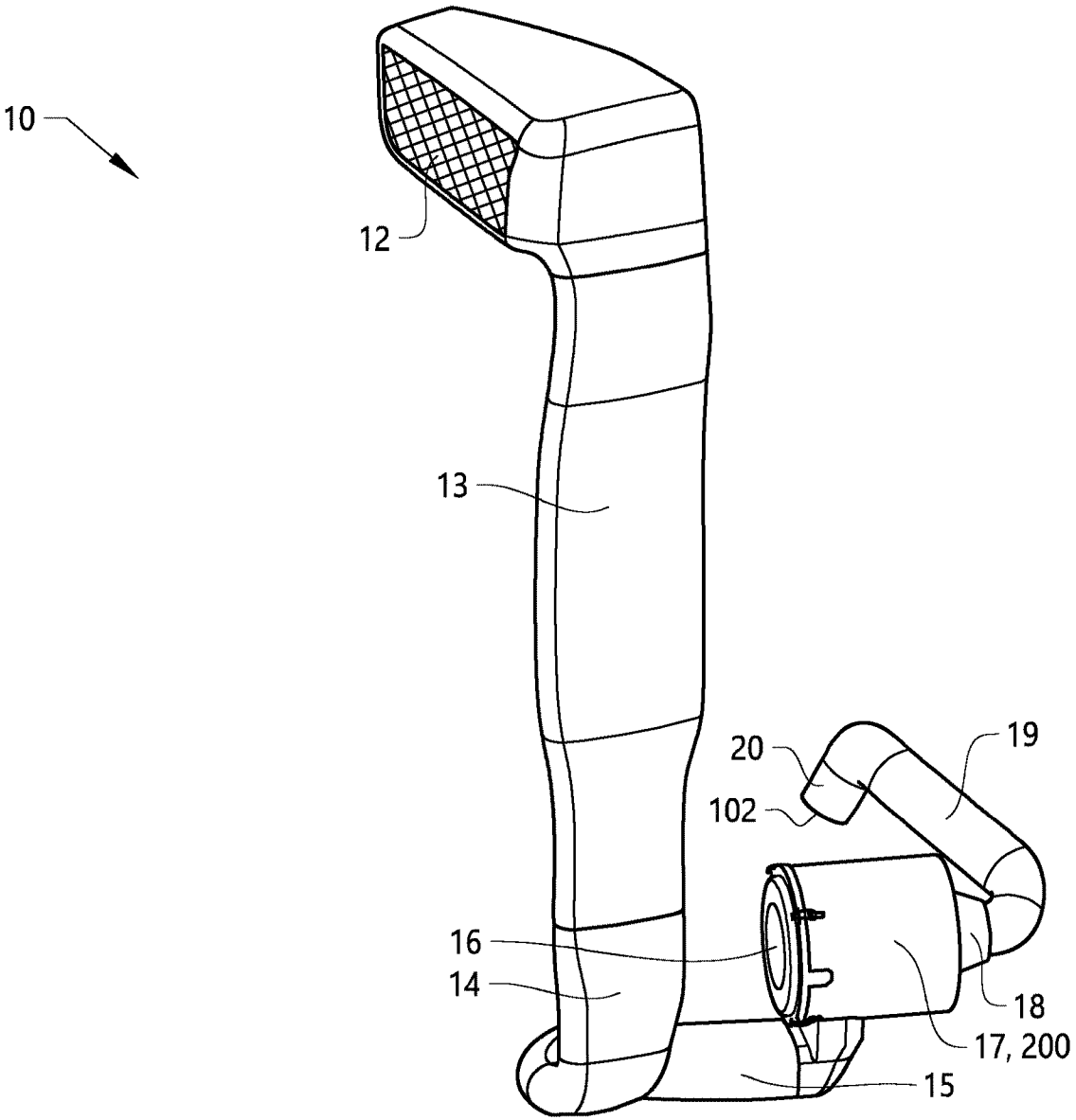
FIG. 2 is a schematic view of an air intake system.

The FIG. 1 vehicle 1 comprises an engine 10 and an air intake system as illustrated in FIG. 2. The air intake system is generally arranged so as to supply air from the outside of a vehicle, e.g. from the outside of the cab, to an internal combustion engine of the vehicle.

The air intake system of FIG. 2 will now be described as an example. However, it is to be understood that the present invention may be applied also in other variants of air intake systems.

The air intake system of FIG. 2 comprises an air intake 12 in connection with outside air. The air intake is in communication with an air duct 13 for transferring air further into the vehicle. The exemplified air duct 13 has an elongated shape which is arranged in a generally vertical direction (with respect to a vertical direction of the vehicle). The air duct 13 leads the air to a bellow 14, which in turn is connected to a turn chamber 15. From the turn chamber 15 the air is fed further downstream to an air cleaner, comprising an air cleaner housing 17 and an air cleaner cover 16. Inside the air cleaner housing 17, an air filter is arranged. The air cleaner cover 16 is removable from the air cleaner housing 17 so as to enable replacement of the air filter when necessary.

The air cleaner housing 17 is in connection with an air cleaner rubber bellow 18 which is in turn connected to an intermediate pipe 19. Downstream the intermediate pipe 19, there is a turbo inlet, here in the form of a turbo inlet rubber bellow 20. From the turbo inlet rubber bellow 20 the air will continue through an inlet 102 downstream towards the internal combustion engine.

It is to be understood that the illustrated air intake system is exemplary, and that the invention may be applied to numerous variants of air intake systems.

In the following, exemplary embodiments of the invention will be described with reference to FIGS. 3 to 8. It will be understood that the cleaner housing 200 described may be used in an air intake system as described in relation to FIG. 2, but also in numerous other variants of air intake systems. Also, the engine air inlet 102 to which the outlet 202 of the described air cleaner housing 200 shall be coupled, may be located at various positions in relation to the air cleaner housing 200, and be connected to the outlet 202 via different types of piping parts.

Figure 3:
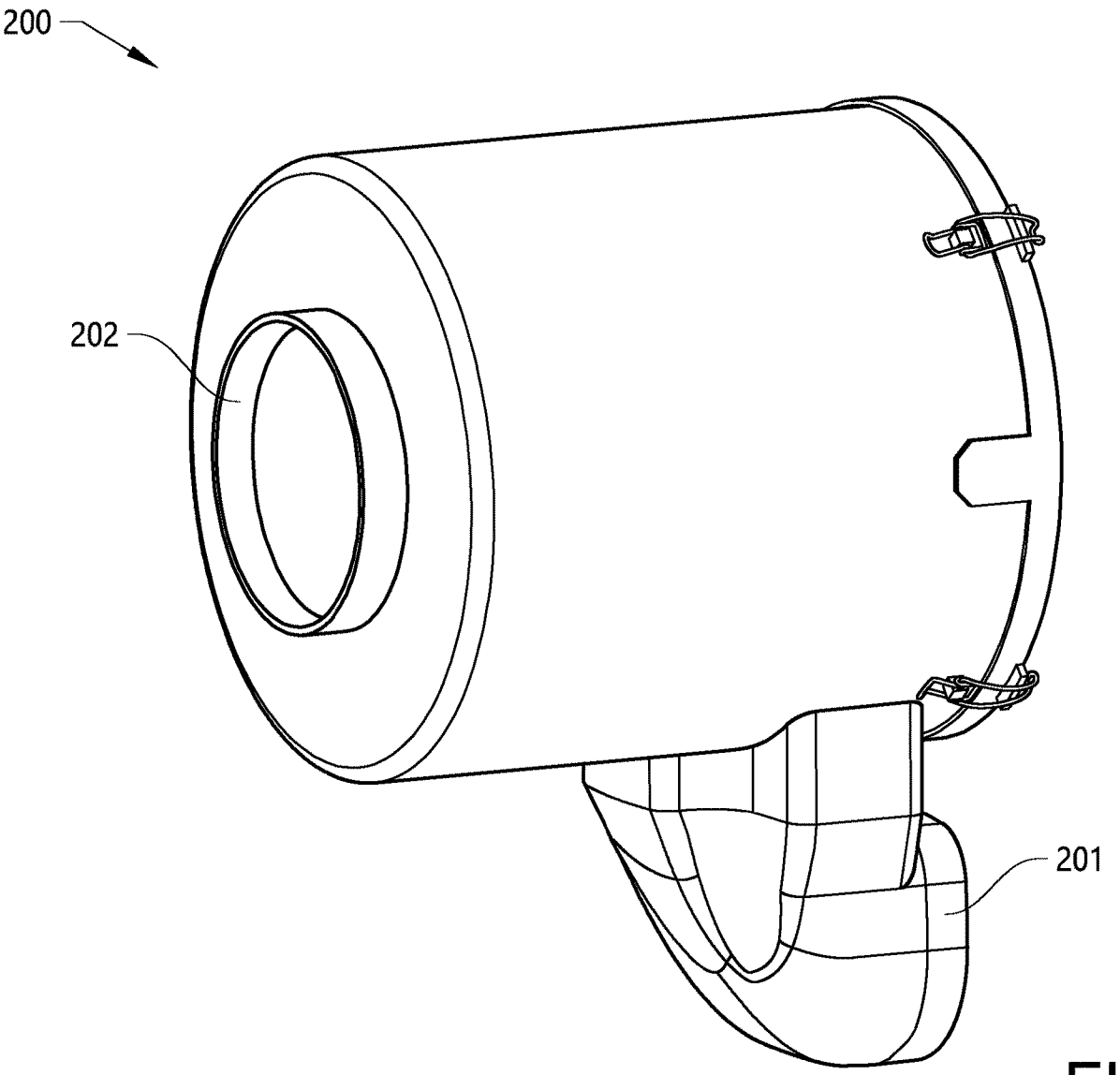
FIG. 3 is a perspective view of a prior art air cleaner housing.

FIG. 3 is a perspective view of a prior art variant of an air cleaner housing 200 for arrangement in a vehicle. The air cleaner housing 200 is configured for receiving unfiltered air and outputting filtered air by passage of the air through an air filter unit housed inside the air cleaner housing 200. Hence, the air cleaner housing 200 comprises an inlet 201 for receiving unfiltered air and an outlet 202 for outputting filtered air, wherein the outlet 202 is configured for connection to an engine air inlet 102 for leading filtered air towards the internal combustion engine. In the illustrated variant, the outlet 202 is centrally arranged in the air cleaner housing 200. The inlet 201 is peripherically arranged. Via the air inlet 201 and outlet 202, the cleaner housing 200 and hence the air cleaner arrangement may be arranged in an air inlet system such as the one described in relation to FIG. 2.

Figure 4B:
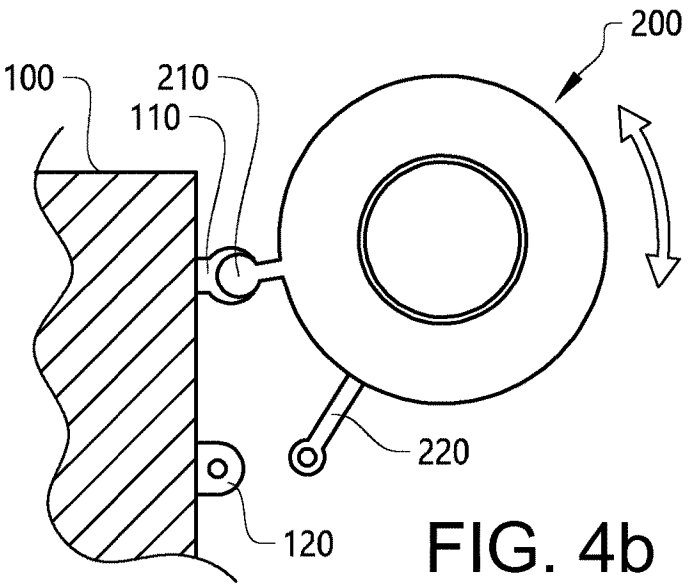
FIG. 4*a* to 4*c* are schematic views of a variant of an air cleaner housing having a slide member, and a corresponding guide member; when the housing and the guide member are in separate (FIG. 4*a*), connected (FIG. 4*b*) and fixed (FIG. 4*c*) positions.
Figure 4A:
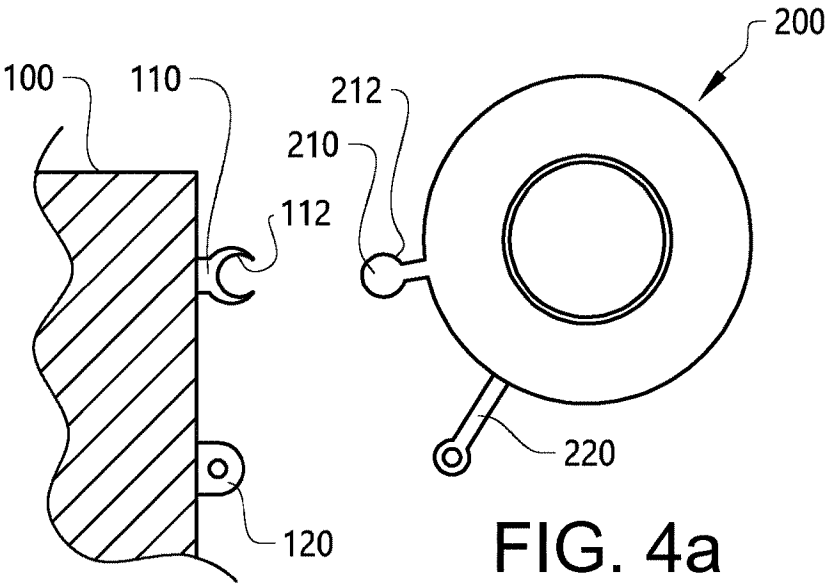

FIG. 4*a* illustrates schematically an air cleaner housing 200 according to a variant of the invention as described herein, and an engine cover 100. The air cleaner housing 200 may in general for example be as illustrated in FIG. 3. Further, the air cleaner housing 200 comprises at least one slide member 210. The slide member 210 is configured to be slidably arranged to a corresponding guide member 110 of an outer cover 100 of the internal combustion engine.

FIG. 4*b* illustrates schematically the air cleaner housing 200 of FIG. 4*a* when the slide member 210 is arranged in connection with the guide member 110. The slide member 210 will hence be slidable along the guide member 110 in a direction perpendicular to the drawing plane. Accordingly, it will be understood that the slide member 210 and hence the air cleaner housing 200 may be moved back and forth along the guide member, so as to facilitate mounting of the outlet 202 of the air cleaner housing 200 to the inlet 102 of the engine.

The slide member 210 may be protruding from the housing 200. In FIGS. 4*a* and 4*b*, the slide member 210 is indeed protruding from the housing, and forms a widened portion, intended to be housed in the guide member 110, and a narrowed portion connecting the widened portion to the housing 200. The slide member 210 comprises, at the widened portion, a substantially circular cross section, as seen perpendicular to the extension of the guide member 110. Such a cross-section may be provided by a guide member 110 having a substantially cylindrical or a substantially spherical portion. The corresponding guide member 110 comprises a groove having a cross-section at least partly following the contour of a circle.

It will be understood that many designs are possible for forming a slide member 210 and a corresponding guide member 110 which allow for the desired slideable movement of the slide member 210 along the guide member 110.

The slide member 210 is to be connected to the guide member 110, such that the air cleaner housing 200 is supported by the guide member 110. To this end, the slide member 210 may optionally define at least one abutment surface 212 which is facing towards the housing 200. With "facing towards" means that a normal to the abutment surface 212 would point in a direction generally towards the housing 200, not necessarily that the normal points perpendicular to the housing 200. In this case, the guide member may advantageously be provided with a corresponding abutment surface 112, facing away from the housing 200. Hence, the contact between the abutment surfaces 212, 112 may hinder the slide member 210 from leaving the guide member 110, and hence the guide member 110 acts to support the air cleaner housing 200.

As exemplified by the variant of FIGS. 4*a* and 4*b*, the slide member 210 may form a widened portion, intended to be housed in the guide member 110, followed by a narrowed portion connecting the widened portion to the housing 200. In this case, the widened portion may advantageously form an abutment surface as described in the above.

Moreover, the slide member 210 may be configured to be pivotable about the corresponding guide member 110, when slidably arranged thereto. In FIG. 4*b*, the air cleaner housing 200 is pivotable in a plane perpendicular to the guide member 110 as indicated by the arrows. As for example in the illustrated variant, the pivotable movement of the slide member 210 is enabled by the arrangement of the slide member 210 and the guide member 110 providing for a play in a pivotal direction. In FIG. 4*b* this is enabled by the opening into the groove of the guide member 110 is wider than a narrowed portion of the slide member 210. Also, the generally circular cross-section of the corresponding portions of the slide member 210 and the guide member 110 allows for smooth pivotable movement of the slide member 210 in relation to the guide member 110.

Although the description relating to FIGS. 4*a* and 4*b* concerns a protruding slide member 210 and hence a corresponding guide member 110 forming an indentation, it will be understood that variants may be envisaged where the slide member 210 instead forms an indentation, and the corresponding guide member 110 a protrusion. For example, the slide member 210 may comprise a ridge, and the guide member 110 a bar. It will be understood that the examples and explanations in the above, may be applied in a similar manner to such embodiments.

Advantageously, the slide member 110 and the guide member 210 may be mutually designed so as to allow for pivotal relative movement of at least 10 degrees, preferably at least 20 degrees, most preferred at least 30 degrees. The pivotable movement may be less than 90 degrees, or at least less than 70 degrees, or at least less than 60 degrees.

The air cleaner housing 200 further comprises a fixation member 220 configured to secure the housing 200 to the outer cover 100 in a fixed position along the guide member 110. Hence, once the outlet 202 has been coupled to the inlet 102 of the engine, the air cleaner housing 200 may be secured to the outer cover 100.

The fixed position may be a freely selectable position. In this case, the fixation member 220 may be configured to be fastened in any freely selectable position on the engine cover 100.

Figure 4C:
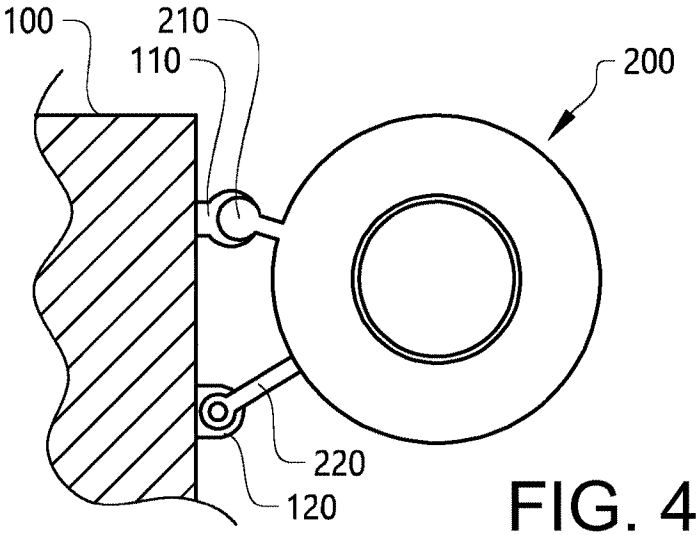

Alternatively, the fixed position may be a predefined position, as in FIGS. 4*a* to 4*c*. In this case, the engine cover 100 may be provided with a fixation device 120 corresponding to the fixation member 220, such that the fixation member 220 may be fixed to the fixation device 120 when the air cleaner housing 200 is in a predetermined position. Such a fixed position is illustrated in FIG. 4*c*.

The fixation member 220 is advantageously separate from the slide member 210. This facilitates using the slide member 210 for moving the air cleaner housing 200 during connection of the outlet 202 to the engine, and then fastening the air cleaner housing via the fixation member 220.

The fixation member 220 may be protruding from the housing 200. In the variant illustrated in FIGS. 4*a*-4*c*, the fixation member 220 protrudes from the housing 200 in a radial direction. The fixation member 200 is also an example of an elongate member, generally forming a bar. As such, the fixation member 200, when attached to the engine cover 100, may act as a leg, that is, to support the air cleaner housing 200 in a position adjacent the engine cover 100. In FIGS. 4*a*, 4*b* it is envisaged that the fixation member 220 may be formed by a "dog bone" bracket.

The fixation member 220 may advantageously cooperate with a fixation means such as a screw or bolt.

The fixation member 220 may be located at an angle of between 20 and 90 degrees from the slide member 210, as seen from a longitudinal axis of the housing 200. This is useful to provide stable support for the air cleaner housing 200 as attached to the cover 100.

When it comes to the design and number of slide members 210 of the air cleaner housing 200, and of the guide members 110 of the engine covers 100, numerous variants may be envisaged, and adapted to the prevailing circumstances such as e.g. the desired position of the air cleaner housing 200 on the engine cover 100, the available space etc.

Figure 5B:
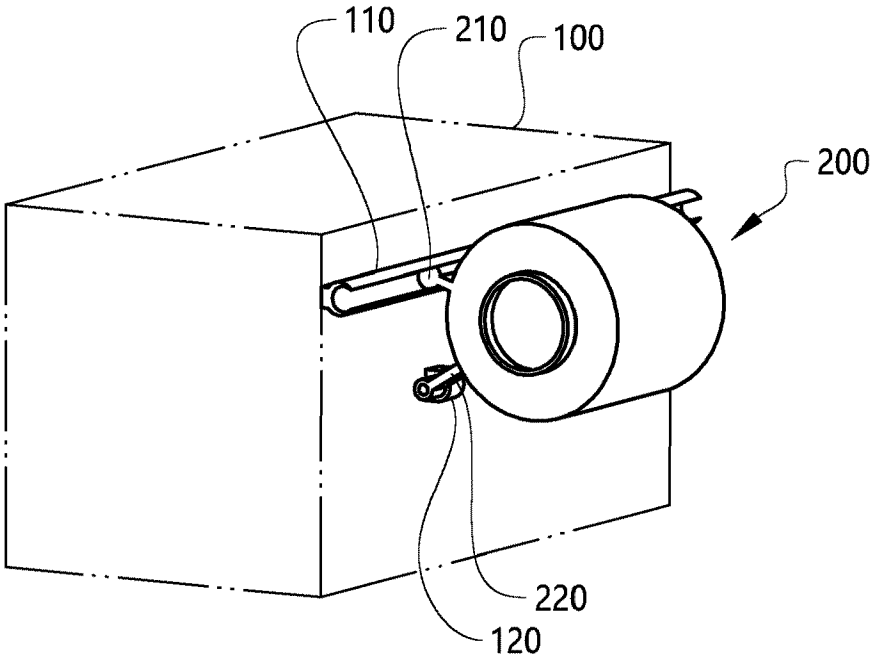
FIGS. 5*a* and 5*b* illustrate schematically a variant of an air cleaner housing attached to an engine cover via a variant of a guide member.
Figure 5A:
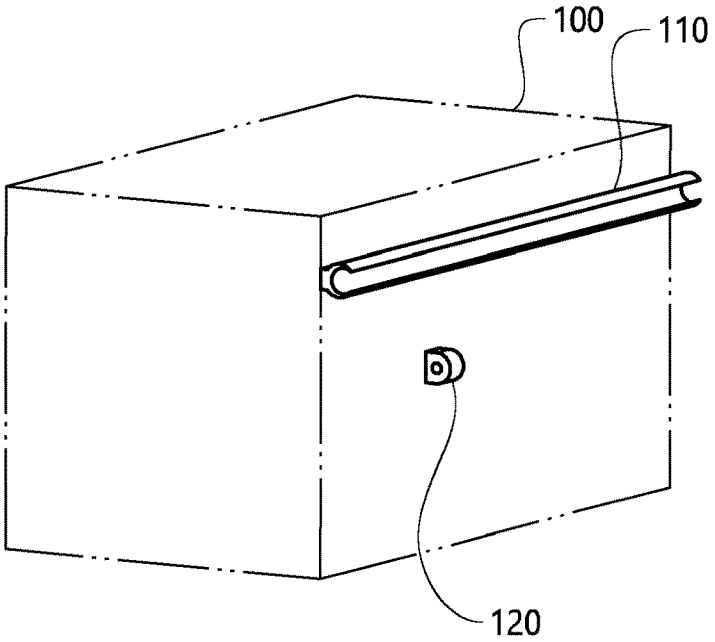

FIGS. 5*a* and 5*b* illustrate schematically a first variant, where FIG. 5*a* illustrates a box representing an engine cover 100 (dashed line), with a guide member 110. In this variant, one single guide member 110 is arranged at the engine cover 100. The guide member 110 may extend over a continuous length of the engine cover 100. FIG. 5*b* illustrates schematically an air cleaner housing 200 being arranged at the engine cover 100. The air cleaner housing 200 comprises at least one, preferably a plurality of slide members 210 which are slidably connected to the guide member 110.

The guide member 110 should preferably have a length exceeding the axial length of the slide member 210 (or the axial extension between a plurality of slide members 210), so that the air cleaner housing 200 may indeed be moved back and forth along the guide member 110 without risk of the slide member 210 leaving the guide member 110.

Advantageously, the arrangement of the slide member 210 and the guide member 110 may provide for movement of the slide member 210 along a length of the guide member 110 (when connected thereto) being at least 1 cm, preferably at least 2 cm, most preferred at least 5 cm.

The guide member 110 may preferably comprise an open end into which the slide member 210 may be threaded by approaching the slide member 210 to the guide member 110 in a direction parallel to the guide member 110. However, other variants are possible. For example, the slide member 210 may be in the form of a hook, in which case the slide member 210 may be coupled to the guide member 110 e.g. by pivoting the slide member 210 towards the guide member 110.

In FIG. 5*b*, the air cleaner cover 200 is fixedly attached to the engine cover 100 by means of a fixation member 220 attached to a fixation device 120.

In FIG. 5*b*, the air cleaner cover 200 is arranged along a vertical side of the engine cover 100. FIG. 5*b* is also one example of the air cleaner cover 200 having a final, fixed position on the same side of the engine cover 100 as the guide member 110. However, numerous arrangement possibilities are available.

Figure 6B:
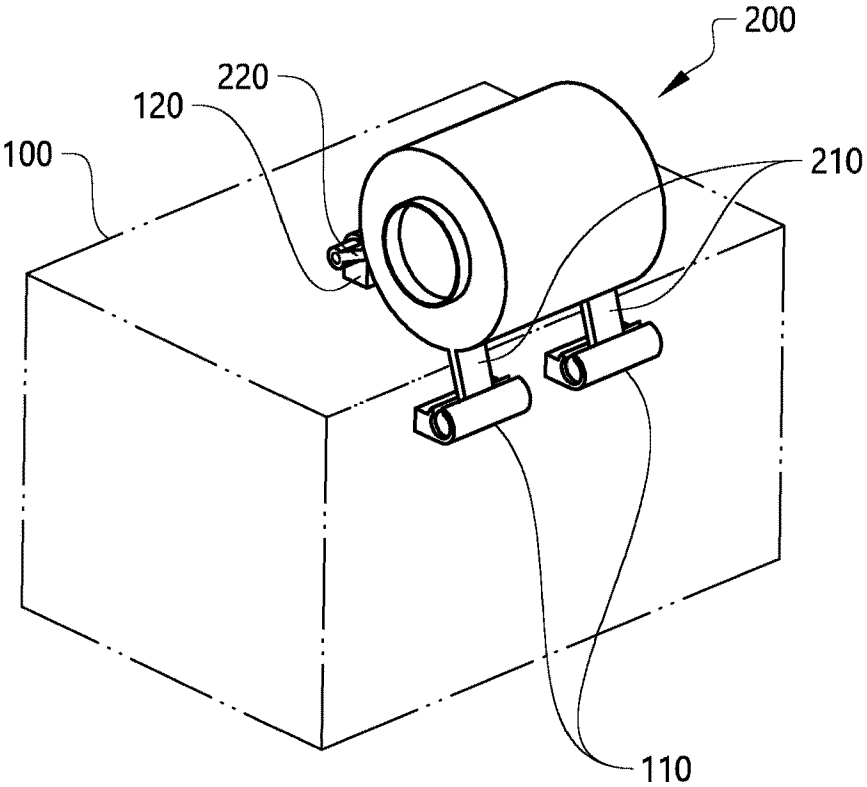
FIGS. 6*a* and 6*b* illustrate schematically another variant of an air cleaner housing attached to an engine cover via another variant of a guide member.
Figure 6A:
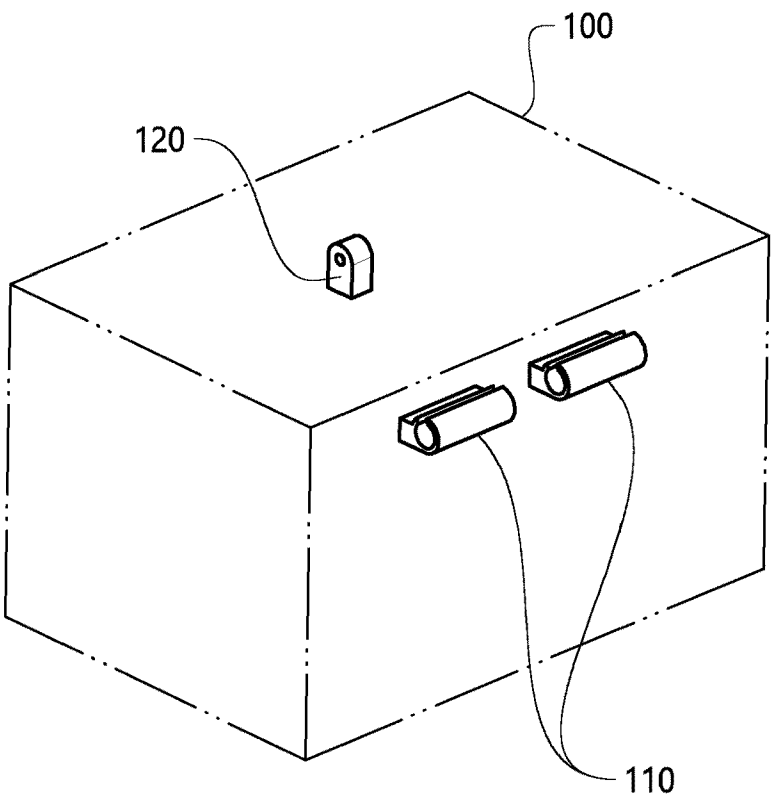

FIGS. 6*a* to 6*b* illustrate schematically another variant. Here, the engine cover 100 comprises two guide members 110. The guide members 110 are relatively short. Each guide member 110 is configured to correspond to a single slide member 210 of the air filter housing 200, as seen in FIG. 6*b*. Hence, each of the guide members 110 should provide for the desired movement of the corresponding side member 210 along the engine cover 100. In the embodiment of FIGS. 6*a* to 6*b*, the final, fixed position of the air cleaner cover 200 is not on the same side of the engine cover 100 as the guide members 110. Instead, the air cleaner cover 200 and slide members 210 are seen to extend over a corner of the air cleaner cover 200. The air cleaner cover 200 comprises a fixation means 220 for fixing the air cleaner housing 200 to the engine cover 100. In the illustrated embodiment, the air cleaner housing 200 comprises two slide members 210, both slide members 210 being arranged along the same axial direction, and one fixation member 220, to be fixed in a fixing device 120. However, it may be preferred to instead provide two fixation members 220 and two fixing devices 120. In such a variant, the slide members 210 and the fixation members 220 will form four "legs" supporting the air cleaner housing 200 when in a fixed position in relation to the engine cover 100.

Figure 7:
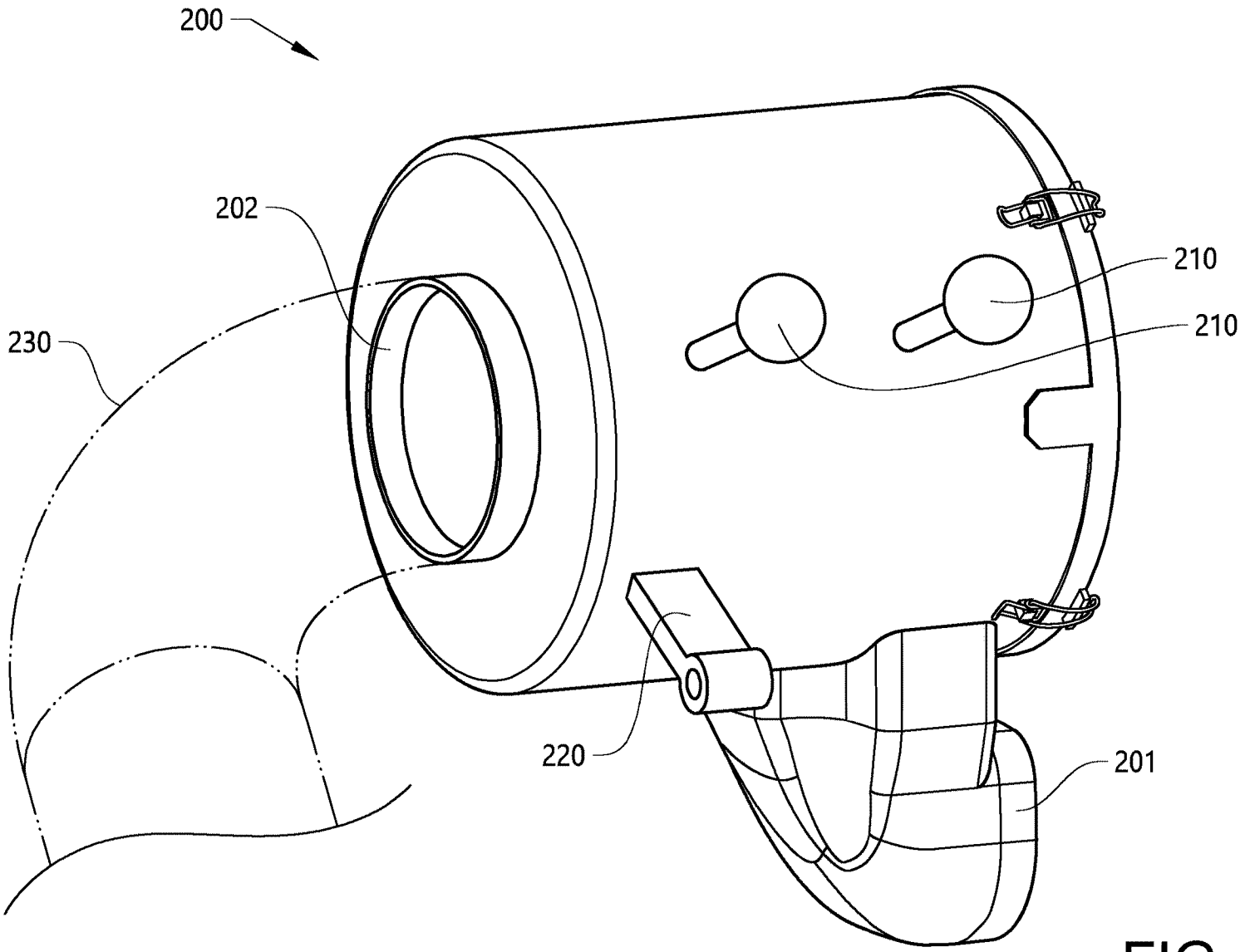
FIG. 7 is a perspective view of an example of an air cleaner housing.

FIG. 7 illustrates another variant of an air cleaner housing 200 as described herein. The air cleaner housing 200 is similar to the prior art housing 200 of FIG. 3 in its outer shape, and in the provision of the inlet 201 and the outlet 202. However, two slide members 210 extend from the air cleaner housing 200. At an angular distance from the slide members, a fixation member 220 in the form of an elongated bracket also extend from the air cleaner cover.

In a dashed line, a pipe bend 230 is illustrated, the pipe bend 230 being connected to the outlet 202 of the air cleaner housing 200. With the arrangement as described herein, an advantage is that the air cleaner housing 200 may be premounted with an air pipe bend 230, which air pipe bend 230 may be mounted to the engine inlet 102 while taking advantages of the axial and/or pivotal play when the air cleaner housing 200 is connected to the guide member 110 via the slide member (s) 210.

Figure 8:
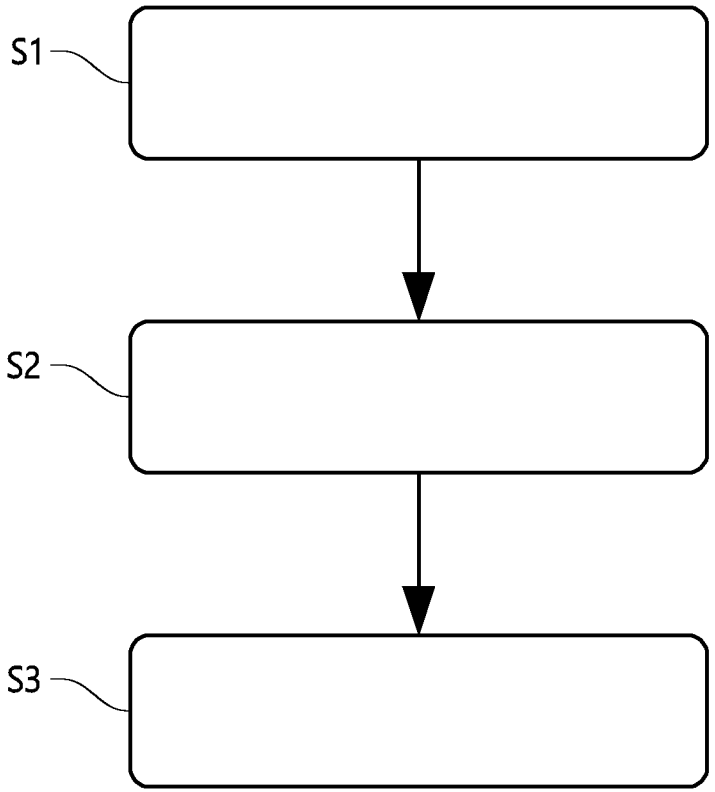
FIG. 8 illustrates schematically a method for mounting an air cleaner housing to an outer cover of an engine.

FIG. 8 illustrates schematically a method for mounting an air cleaner housing 200 as described herein to an outer cover 100 of an engine. The method comprises the step S1 of connecting the slide member 210 of the housing 200 to the guide member 110 of the outer cover 100, so as to slidably arrange the housing 200 to the guide member 110, the step S2 of connecting the outlet 202 of the housing 200 to the engine air inlet 102 towards the engine, and the step S3 of fixing the fixing member 220 of the housing to the outer cover 100 so as to secure the housing 200 in a fixed position along the guide member 110.

The method may comprise connecting the outlet 202 to a compressor pipe of the engine. The method may comprise connecting the outlet 202 to a compressor pipe of the engine using a single part connection.

In particular, the method may comprise, after the step S1 of connecting the slide member 210 of the air cleaner housing 200 to the guide member 110, releasing the air cleaner housing 200 so that it is supported by the guide member 110. Thereafter the outlet 202 of the housing 200 may be coupled to the engine air inlet 102 (S2) while using the play provided by the guide member 110 and slide member 210 connection.

The air cleaner housing 200 may be pre-mounted with such a single part connection 230 being arranged to the outlet 202. In this case, the step S2 of connecting the outlet 202 to the engine air inlet 102 comprises connecting the connection 230 to the engine air inlet 102, for example connecting the connection 230 to an inlet 102 to a compressor or a turbo of an engine.

The method as described herein may advantageously be performed in an engine pre-assembly station.

It is to be understood that the present invention is not limited to the embodiments described above and illustrated in the drawings; rather, the skilled person will recognize that many changes and modifications may be made within the scope of the appended claims.

The invention claimed is:

1. An air cleaner housing for an air filter for an internal combustion engine in a vehicle, comprising:
   - an inlet for receiving unfiltered air and an outlet for outputting filtered air,
   - at least one slide member configured to be slidably arranged to a corresponding guide member comprising a groove of an outer cover of the internal combustion engine in a vehicle, such that, when the slide member is in connection with the guide member, the air cleaner housing is supported by the guide member, and the air cleaner housing is slidably movable at least along the guide member, the at least one slide member each comprising an outer surface having a partly circular cross-section; and
   - a fixation member comprising a bracket configured to secure the housing to the outer cover in a fixed position along the guide member.

2. The air cleaner housing of claim 1, wherein the slide member is configured to be pivotable about the corresponding guide member when slidably arranged thereto, such that, when the slide member is in connection with the guide member, the air cleaner housing is pivotable about the guide member.

3. The air cleaner housing of claim 1, wherein the slide member protrudes from the housing.

4. The air cleaner housing of claim 1, wherein the slide member defines at least one abutment surface which is facing towards the housing.

5. The air cleaner housing of claim 1, wherein the slide member comprises a generally cylindrical protrusion or a generally spherical protrusion.

6. The air cleaner housing of claim 1, wherein the fixation member is separate from the slide member.

7. The air cleaner housing of claim 1, wherein the fixation member is protruding from the housing.

8. The air cleaner housing of claim 1, wherein the fixation member is located at an angle of between 20 and 90 degrees from the slide member, as seen from a longitudinal center axis of the housing.

9. The air cleaner housing of claim 1, wherein the fixation member is elongated.

10. An air cleaner housing arrangement comprising:

an outer cover of an internal combustion engine, the outer cover comprising at least one guide member comprising at least one groove; and an air cleaner housing for an air filter for the internal combustion engine in a vehicle, the air cleaner housing is adapted for attachment to the outer cover of the internal combustion engine, and comprising:

an inlet for receiving unfiltered air;

an outlet for outputting filtered air;

at least one slide member comprising at least one protruding outer surface;

a fixation member comprising a bracket configured to secure the housing to the outer cover in a fixed position along the guide member;

wherein each of the at least one slide member and the at least one guide member are mutually configured such that the slide member is slidably arrangeable to and pivotable about the guide member, such that, when the slide member is in connection with the guide member, the air cleaner housing is supported by and pivotable about the guide member, and the air cleaner housing is slidably movable at least along the guide member.

11. The air cleaner housing of claim 10, wherein the at least one slide member of the air cleaner housing comprises at least two slide members comprising at least two protruding outer surfaces, and/or wherein the at least one guide member of the outer cover comprises at least two guide members comprising at least two grooves.

12. The air cleaner housing of claim 10 wherein the outer cover is provided with at least one fixation device configured for securing the housing to the outer cover by cooperation with the fixation member.

13. A method for mounting an air cleaner housing to an outer cover of an engine comprising an engine air inlet, comprising:

connecting a slide member of the housing to a guide member comprising a groove of the outer cover, so as to slidably arrange the air cleaner housing to the guide member, the slide member comprising an outer surface having a partly circular cross-section;

connecting an outlet of the housing to the engine air inlet; and fixing a fixation member comprising a bracket to the outer cover so as to secure the housing in a fixed position along the guide member.

14. The method according to claim 13, wherein the engine air inlet is an inlet to a compressor and/or a turbo, and connecting the outlet to the engine air inlet is performed using a single part connection.

* * * * *